United States Patent [19]

Folsom et al.

[11] Patent Number: 5,036,767

[45] Date of Patent: Aug. 6, 1991

[54] OPTICAL WINDOW FOR LASER-INITIATED EXPLOSIVE DEVICES

[75] Inventors: Mark Folsom, Hollister, Calif.; John Petrick, Litchfield Park, Ariz.

[73] Assignee: Whittaker Ordnance, Inc., Hollister, Calif.

[21] Appl. No.: 546,649

[22] Filed: Jul. 2, 1990

[51] Int. Cl.[5] ..... F42B 3/113; F42C 19/00

[52] U.S. Cl. ..... 102/201

[58] Field of Search ..... 102/201

[56] References Cited

U.S. PATENT DOCUMENTS

| | | | |
|---|---|---|---|
| 3,528,372 | 9/1970 | Lewis et al. | 102/201 |
| 3,812,783 | 5/1974 | Yang et al. | 102/201 |
| 4,870,903 | 10/1989 | Carel et al. | 102/201 |
| 4,917,014 | 4/1990 | Loughry et al. | 102/201 |

*Primary Examiner*—Charles T. Jordan

*Attorney, Agent, or Firm*—Donald E. Nist

[57] ABSTRACT

The optical window is useful in laser-initiated explosive devices. It includes a solid transparent block of high temperature-resistant material such as glass, quartz, corundum, cubic zirconia or the like having two opposed light input and light output surfaces, one or both of which bear ablative mirror coatings of metal or the like, preferably aluminum, silver or gold, which can be vaporized by a laser beam. Preferably, the coatings are covered by a protective ablative film which resists scratching or the like. Such may be, for example, silicon monoxide. The coatings reflect incident light so as to prevent inadvertent initiation of explosive situated behind or downstream of the window in an explosive device. Preferably, the block is cylindrical with a curved light-focusing input surface which reduces the intensity which the laser beam trained through the window has to have in order to vaporize the mirror coatings and set off the explosive. In one embodiment both the input and output surfaces of the block are coated with the mirrors, but the input surface mirror has a central opening alignable with an optic fiber transmitting a laser beam, in order to facilitate passage of the beam into the block, while still providing protection against stray radiation. When the mirror coating on the output end of the window vaporizes, its vaporization products facilitate and augment the detonation of the exposive by the laser beam.

9 Claims, 2 Drawing Sheets

OPTICAL WINDOW FOR LASER-INITIATED EXPLOSIVE DEVICES

BACKGROUND OF THE INVENTION

1. Field of the Invention

The present invention generally relates to explosive devices and more particularly to an improved optical window for a laser-initiated explosive device.

2. Prior Art

Most laser-initiated explosive devices use no protective window upstream of the initiator to help seal off the initiator from the environment, or else they rely on uncoated glass or plastic windows for such purposes. There is always a danger, with or without such windows, that stray radiation can inadvertently initiate an explosion. It would therefore be desirable to be able to provide an effective barrier against such stray radiation while still permitting laser initiation of an explosion.

It would also be desireable to be able to provide means for returning low intensity test signals passing through an optical transmission system connected to an explosive initiator in order to test the integrity of the system. It would be further desireable to be able to facilitate and augment burning or detonation in the explosive material of an explosive initiator. Dichroic coatings comprising complex and expensive stacks of dielectric thin films have been used to pass signals of a given wavelength while reflecting signals of another given wavelength but offer no broad spectrum protection against stray radiation. Moreover, they do not augment or facilitate burning or explosive detonation.

SUMMARY OF THE INVENTION

The improved optical window of the present invention satisfies all the foregoing needs. The window is substantially as set forth in the Abstract of the Disclosure. Thus, the window is useful in laser-initiated explosive devices. The window comprises a solid block of transparent high temperature-resistant material such as glass, quartz or corundum. It could also be cubic zirconia, yttrium aluminum garnet or another suitable material. The block has two opposed surfaces, that is, the light input surface and the light output surface.

An ablative mirror coating is disposed on at least one of the block's opposed surfaces and preferably on both such surfaces. The mirror coating has the effect of reflecting incident light and thus it protects the explosive initiator against inadvertent initiation from stray radiation. However, it is ablatable by laser light so that impingement of intense laser radiation on the mirror coating vaporizes the coating and allows the transmission of laser light through the block to the explosive initiator in the device downstream of the output end of the window. The mirror coating is preferably of one or more metals such as aluminum, silver, gold and the like, and is preferably protected against degradation prior to ablation by a protective film of ablative material such as silicon monoxide or the like.

Preferably, the block has a curved light-focusing input surface in order to reduce the intensity of the light necessary to effect the desired ablation and explosive initiation. The window may also have a central small opening or aperture in the mirror coating on one of the opposed mirrored surfaces while the other of the two opposed surfaces has the mirror coating extending through the entire area thereof. The central opening facilitates passage of the laser light through the block while still allowing reflection of radiation from the mirror coating surrounding the aperature.

Various other aspects and features of the improved optical window of the present invention are set forth in the following detailed description and the accompanying drawings.

DRAWINGS

DETAILED DESCRIPTION

FIGS. 1 AND 2

Figure 1:
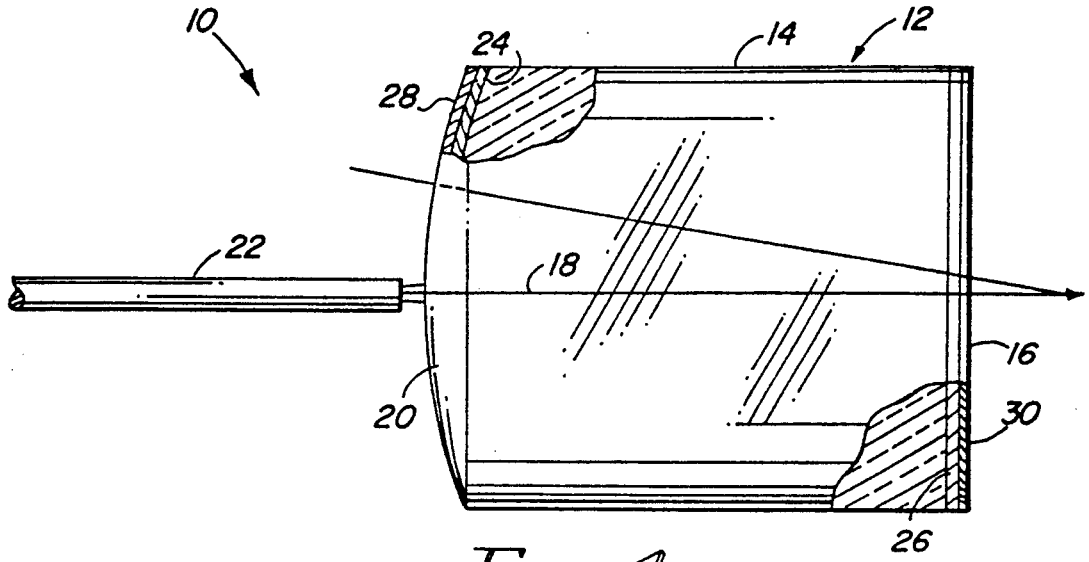
FIG. 1 is a schematic side elevation of a first preferred embodiment of the improved optical window of the present invention, shown with a laser beam-transmitting fiber adjacent to the light input surface thereof.
Figure 2:
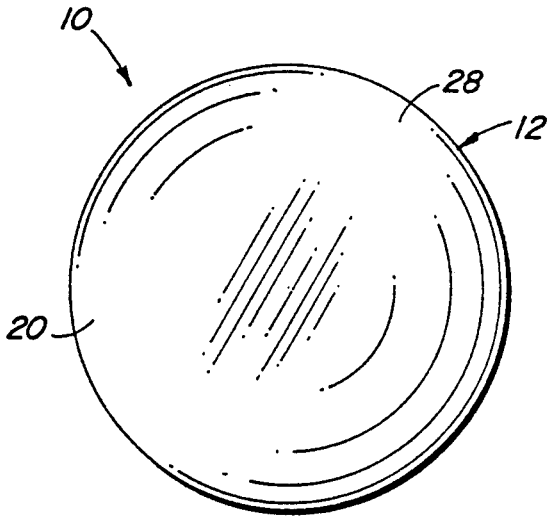
FIG. 2 is a schematic front elevation of the optical window of FIG. 1.

Now referring more particularly to FIGS. 1 and 2 of the accompanying drawings, a first preferred embodiment of the improved optical window of the present invention is schematically depicted therein. Thus, window 10 is shown which comprises a solid transparent block 12 of high temperature-resistant material such as glass, quartz, corundum, yttrium aluminum garnet, cubic zirconia or the like. Block 12 may be any suitable size and shape and is adapted to be sealed into the housing of an explosive initiator-containing device ( not shown ) immediately upstream of the initiator so as to physically protect it from the environment.

As shown in FIGS. 1 and 2, block 12 is a single piece of material in the form of a cylinder 14 having a flat vertical rear surface 16 out through which a light beam, specifically a laser beam 18, exits, and an opposite front surface 20 through which laser beam 18 passes from optical fiber 22 into block 12. Surface 20 is curved, being a segment of a sphere, so as to focus light and thus reduce the intensity of beam 18 required to pass through block 12 and initiate an explosion of the initiator in the explosive device referred to above.

Both surface 20 and surface 16 are fully covered by identical mirror coatings 24 and 26, respectively. Preferably, coatings 24 and 26 are of metal deposited in a thickness of, for example, about 2–20 micrometers, by a conventional metal deposition process utilized for producing conventional mirrors. The metal preferably is aluminum, silver, gold or another vaporizable metal or mixture of metals. Thus, mirror coatings 24 and 26 are highly reflective and ablatable by a laser beam, such as beam 18 from optical fiber 22 positioned next to surface 20. Coatings 24 and 26 are protected against scratching, wear, oxidation, etc. Preferably by protective thin films 28 and 30 of, for example, a few microns in thickness of an ablatable material such as silicon monoxide or the like. Organic materials can also be used, such as silicone plastics, etc. as the protective films 28 and 30.

All incident light is reflected off of mirror coatings 24 and 26 so that the light cannot pass to the initiator ( not shown) positioned adjacent to but downstream from surface 16 and inadvertently set off the initiator. It is only when laser beam 18 impinges on film 28 and coating 24 sufficiently intensely to vaporize them that beam 18 can pass into and through block 12 to mirror 26 and vaporize it and film 30 so as to exit block 12 to the initiator to cause ignition. Vaporization of the metallic coating 26 has the additional effect of injecting hot gases, liquids and particles from the coatings into the explosive material to facilitate and augment burning or detonation in the explosive material.

Mirrors 24 and 26 are also useful in returning (reflecting ) low intensity test signals pulsed through the optical transmission system incorporating window 10 in order to determine the integrity of the system.

Accordingly, window 10 is simple, inexpensive, durable and efficient in providing a maximum of protection to the initiator of the explosive device while also increasing the efficiency of the detonation and the ability to test the system .

FIG. 3

Figure 3:
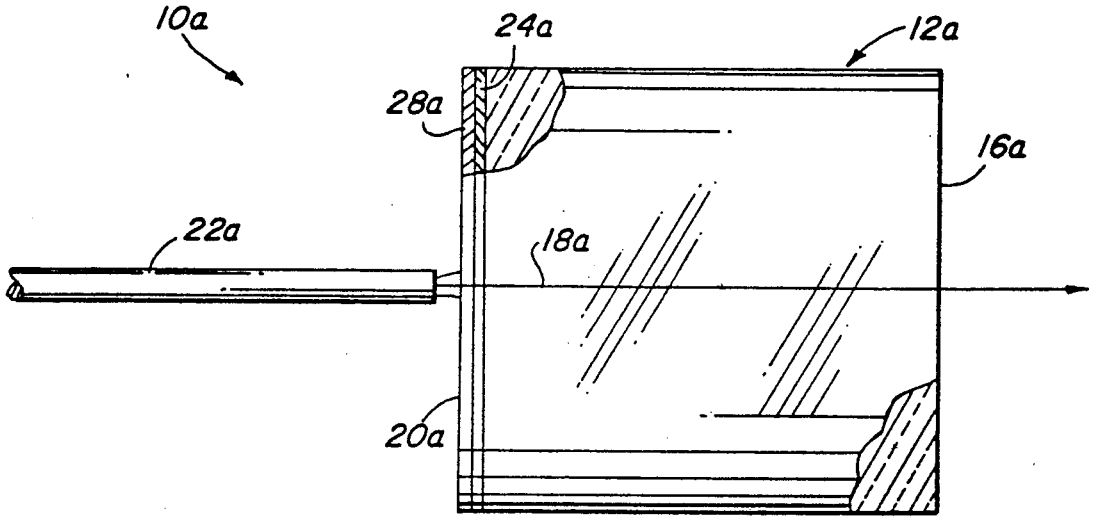
FIG. 3 is a schematic side elevation of a second preferred embodiment of the improved optical window of the present invention, shown with a laser beam-transmitting fiber adjacent thereto.

A second preferred embodiment of the improved optical window of the present invention is schematically depicted in FIG. 3 of the drawings. Thus, window **10*a* is shown. Components thereof similar to those of window 10** bear the same numerals but are succeeded by the letter "a".

Window **10*a* is substantially identical to window 10**, except as follows:

a) block **12*a* is a cylinder with flat opposite end surfaces 16*a* and 20*a*; and, b) only surface 20*a* bears a mirror coating 24*a* and film 28*a*, surface 16*a* being devoid of a coating or protective film. Window 10*a* is non-focusing but has the other properties of window 10 in handling beam 18*a* from fiber 22*a***.

FIG. 4

Figure 4:
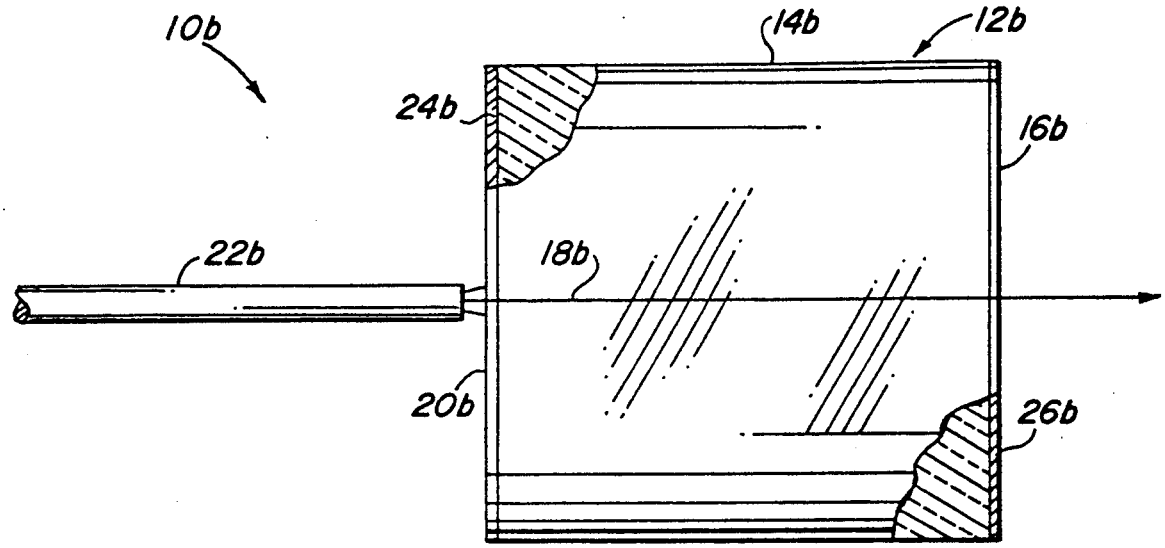
FIG. 4 is a schematic side elevation of a third preferred embodiment of the improved optical window of the present invention, shown with a laser beam-transmitting fiber adjacent thereto.

A third preferred embodiment of the improved optical window of the present invention is schematically depicted in FIG. 4. Thus, window **10*b* is shown. Components thereof similar to those of window 10 bear the same numerals but are succeeded by the letter "b". Window 10*b* is substantially identical to window 10**, except as follows:

a) block **12*b* is a cylinder with flat opposite end surfaces 16*b* and 20*b*; and, b) surfaces 16*b* and 20*b* bear, respectively, mirror coatings 24*b* and 26*b*, but those coatings have no protective films thereover, such as films 28 and 30 of window 10. Window 10*b* is similar in properties to window 10*a***.

Figure 5:
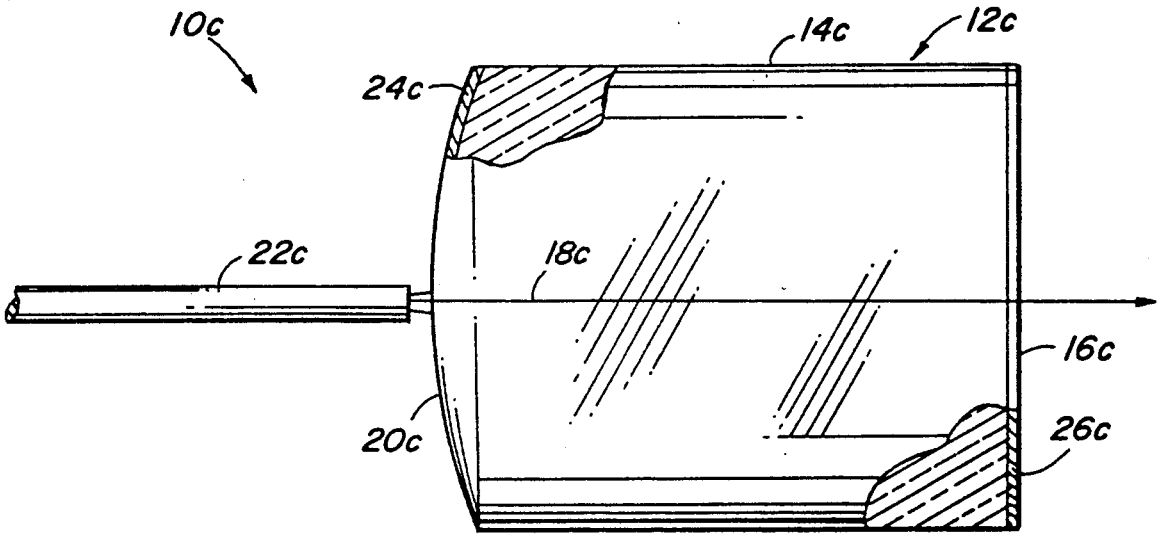
FIG. 5 is a schematic side elevation of a fourth preferred embodiment of the improved optical window of the present invention, shown with a laser beam-transmitting fiber adjacent thereto; and, FIG. 6 is a schematic front elevation of the optical window of FIG. 5.
Figure 6:
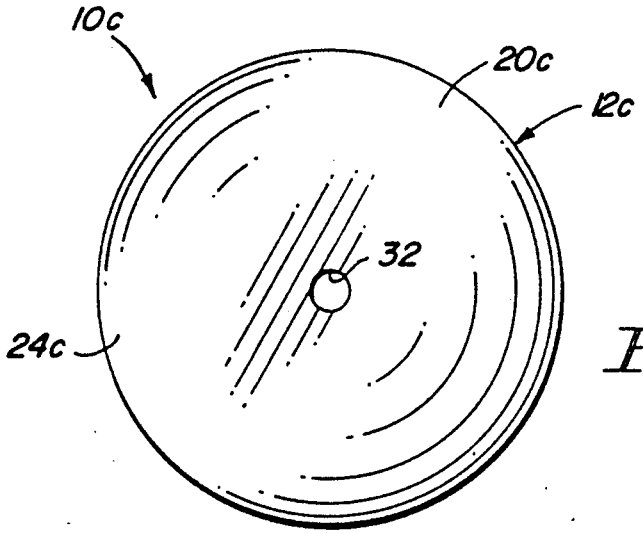

FIGS. 5 and 6

A fourth preferred embodiment of the improved optical window of the present invention is schematically depicted in FIGS. 5 and 6. Thus, window **10*c* is shown. Components thereof which are similar to those of window 10 bear the same numerals but are succeeded by the letter "c". Window 10*c* is identical to window 10**, except as follows :

a) window **10*c* has no protective film such as films 28 and 30 over mirror coatings 24*c* and 26*c*; and, b) mirror coating 24*c* has a central small opening 32 therein with which optical fiber 22*c* is aligned for delivery of laser beam 18*c* thereto. Opening 32 facilitates entry of beam 18*c* into block 12*c* where it passes to mirror coating 26*c*. Since coating 26*c* has no such opening, beam 18*c* must ablate an opening therein before it can pass downstream of window 10*c* into an initiator ( not shown ) positioned at such location. The remaining area of surface 20*c* is covered with coating 24*c* which reflects incidental radiation, as does coating 26*c*. Window 10*c* has the other properties of window 10**.

Various other modifications, changes, alterations and additions can be made in the improved optical window of the present invention and in its components and their parameters. All such modifications, changes, alterations and additions as are within the scope of the appended claims form part of the present invention.

What is claimed is:

1. An improved optical window for a laser-initiated explosive device, said window comprising, in combination:

a) a solid transparent block of high temperature resistant material, said block having two opposed light input and light output surfaces so that light can pass into, through and out of said block; and, b) an ablative mirror coating on at least one of said opposed surfaces, said mirror coating reflecting incident light but ablatable by laser light to subsequently permit transmission of laser light through said opposed surfaces to an explosive initiator disposed adjacent said light output surface, said mirror coating being covered by a protective solid film of laser light-vaporizable material.

2. The improved optical window of claim 1 wherein said block comprises at least one of glass, quartz or corundum.

3. The improved optical window of claim 1 wherein said mirror coating comprises a laser light-vaporizable metal coating.

4. The improved optical window of claim 3 wherein said metal of said mirror coating comprises at least one of aluminum, silver and gold.

5. The improved optical window of claim 1 wherein said film material comprises silicon monoxide.

6. The improved optical window of claim 1 wherein said block has a curved light-focusing input surface.

7. The improved optical window of claim 1 wherein said mirror coating is present only on said input surface.

8. The improved optical window of claim 1 wherein said mirror coating is present only on said output surface.

9. An improved optical window for a laser-initiated explosive device, said window comprising, in combination:

a) a solid transparent block of high temperature resistant material, said block having two opposed light input and light output surfaces so that light can pass into, through and out of said block; and, b) an ablative mirror coating on both of said opposed surfaces, one of said opposed surfaces having a mirror coating with a central opening therein while the other of said opposed surface, said mirror coating reflecting incident light but ablatable by laser light to subsequently permit transmission of laser light through said opposed surfaces to an explosive initiator disposed adjacent said light output surface.

* * * * *